US008104886B2

(12) United States Patent
You et al.

(10) Patent No.: US 8,104,886 B2
(45) Date of Patent: Jan. 31, 2012

(54) IMAGE FORMING APPARATUS TO PRINT ACCORDING TO A PLURALITY OF IMAGE FORMING TYPES

(75) Inventors: Ho-gun You, Hwaseong-si (KR); Yong-duk Lee, Gunpo-si (KR); Dong-hun Han, Suwon-si (KR); Sin-ae Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 175 days.

(21) Appl. No.: 12/049,476

(22) Filed: Mar. 17, 2008

(65) Prior Publication Data

US 2008/0316245 A1 Dec. 25, 2008

(30) Foreign Application Priority Data

Jun. 20, 2007 (KR) ..... 10-2007-0060431

(51) Int. Cl.
*B41J 2/01* (2006.01)

(52) U.S. Cl. ..... 347/104; 347/101

(58) Field of Classification Search ..... 347/104
See application file for complete search history.

(56) References Cited

U.S. PATENT DOCUMENTS 6,340,157 B1 * 1/2002 Watanabe et al. ..... 271/301
2005/0056988 A1 * 3/2005 Lee et al. ..... 271/9.05

FOREIGN PATENT DOCUMENTS

JP 8-310047 11/1996
JP 08310047 A * 11/1996
JP 9-311513 12/1997

OTHER PUBLICATIONS

Chinese Office Action issued Mar. 23, 2011 in CN Application No. 200810097354.7.

* cited by examiner

*Primary Examiner* — Shelby Fidler
(74) *Attorney, Agent, or Firm* — Stanzione & Kim, LLP

(57) ABSTRACT

An image forming apparatus having a first image forming unit and a second image forming including a printing medium supplier which supplies a printing medium, a selection guide which selectively guides the printing medium from the printing medium supplier to one of a first supplying path of the first image forming unit and a second supplying path of the second image forming unit, and a first feed roller which is disposed between the selection guide and the printing medium supplier, and transfers the printing medium from the printing medium supplier to the selection guide.

16 Claims, 4 Drawing Sheets

IMAGE FORMING APPARATUS TO PRINT ACCORDING TO A PLURALITY OF IMAGE FORMING TYPES

CROSS-REFERENCE TO RELATED APPLICATIONS

This application claims priority under 35 U.S.C 119(a) from Korean Patent Application No. 10-2007-0060431, filed on Jun. 20, 2007 in the Korean Intellectual Property Office, the disclosure of which is incorporated in its entirety.

BACKGROUND OF THE INVENTION

1. Field of the Invention

The present general inventive concept relates to an image forming apparatus, and more particularly, to an image forming apparatus which is capable of printing according to a plurality of image forming types.

2. Description of the Related Art

An image forming apparatus is an electronic device which forms a desired image on a printing medium. The image forming apparatus may be classified according to image forming types including: an inkjet image forming apparatus which discharges an ink droplet to form an image; an electrophotographic image forming apparatus which forms an image using toner through charging, exposing, developing, transferring, and cleaning operations; and a thermoelectronic image forming apparatus which uses an ink ribbon.

Generally, the image forming apparatus forms an image using only one of the foregoing image forming types. If a user desires to print with an inkjet type in one instance and with an electrophotographic type in another instance, the user should have both an inkjet printer and a laser printer to respectively provide the desired image forming types.

To solve the above a problem, image forming apparatuses which employ both an electrophotographic type and an inkjet type as discussed below.

Japanese Patent First Publication No. H09-311513 discloses an image forming apparatus which includes an inkjet image forming unit and an electrophotographic image forming unit on a single printing medium transfer path. However, the above image forming apparatus has a problem such that a printing medium printed by one of the image forming types may be adversely affected by elements of the other image forming type. For example, if the printing medium printed by the inkjet unit passes through the elements of an image receptor and a fusing unit disposed within the electrophotographic unit, the foregoing elements may be contaminated by wet ink on the printing medium. Alternatively, if the printing medium passes through the fusing unit of the electrophotographic unit, thereby causing the printing medium to have a higher temperature, and then passes through a head chip of an inkjet unit, the head chip will be thermally deformed and printing quality may be degraded.

To solve the foregoing problem, Japanese Patent First Publication No. H08-310047 discloses an image forming apparatus which includes an electrophotographic unit and an inkjet unit on different printing medium moving paths. In this case, however, a plurality of rollers are disposed on the printing medium moving paths to move the printing medium, thereby causing a complicated printing medium moving configuration and raising production costs.

SUMMARY OF THE INVENTION

The present general inventive concept provides an image forming apparatus which simplifies a printing medium moving configuration and employs a plurality of image forming types.

The present general inventive concept also provides an image forming apparatus which reduces production costs and employs a plurality of image forming types.

The present general inventive concept also provides an image forming apparatus which improves accuracy in moving a printing medium and employs a plurality of image forming types.

Additional aspects and/or utilities of the present general inventive concept will be set forth in part in the description which follows and, in part, will be obvious from the description, or may be learned by practice of the present invention.

The foregoing and/or other aspects of the present general inventive concept can be achieved by providing an image forming apparatus having a first image forming unit and a second image forming unit including a printing medium supplier which supplies a printing medium, a selection guide which may selectively guide the printing medium from the printing medium supplier to one of a first supplying path of the first image forming unit and a second supplying path of the second image forming unit, and a first feed roller which may be disposed between the selection guide and the printing medium supplier, and may transfer the printing medium from the printing medium supplier to the selection guide.

The first image forming unit and the second image forming unit are different image forming types.

The image forming apparatus may also include a second feed roller which moves the printing medium guided along the first supplying path to the first image forming unit.

A distance from the first feed roller to the second feed roller may be shorter than a length of a predetermined printing medium.

The image forming apparatus may also include a driver which drives the first feed roller and the second feed roller.

The image forming apparatus may also include a controller which controls the driver to drive the first feed roller while the second feed roller is in an idle state, to align the printing medium.

The image forming apparatus may also include a controller which controls the driver to set the first feed roller in an idle state after the second feed roller grips the printing medium.

The first image forming unit may include a printing head which has a nozzle to discharge an ink.

The second image forming unit may include an image receptor which forms a toner image thereon, and a transfer roller which grips the printing medium that is guided along the second supplying path having the image receptor and transfers the toner image to the printing medium.

A distance from the first feed roller to the image receptor or the transfer roller that grips the printing medium is shorter than a length of a predetermined printing medium.

The image forming apparatus may also include a driver which drives the image receptor, the transfer roller and the first feed roller; and a controller which controls the driver to set the first feed roller in an idle state if the printing medium is gripped by the image receptor and the transfer roller.

The printing medium supplier may include a plate which stores the printing medium, and a pickup roller which picks up the printing medium and transfers the printing medium to the first feed roller.

The image forming apparatus may also include a driver which drives the first feed roller and the pickup roller.

The image forming apparatus may also include a controller which controls the driver to set the pickup roller in an idle state if the driver drives the first feed roller.

The image forming apparatus may also include a controller which controls the driver to drive the pickup roller while the first feed roller is in an idle state, to align the printing medium.

The image forming apparatus may also include a controller which controls the selection guide to select one of the first and second supplying paths corresponding to a user's selection.

The foregoing and/or other aspects and utilities of the present general inventive concept may also be achieved by providing an image forming apparatus having a selection guide to selectively guide a printing medium from a common path to a first supplying path of a first image forming unit and a second supplying path of a second image forming unit, and a first feed roller which may be disposed in the common path to feed the printing medium along the first supplying path for a first period of time and along the second supplying path for a second period of time.

The first supplying path may correspond to a first length and the second supplying path corresponds to a second length and the first length may be longer than the second length.

The first length may be the distance from the first feed roller to a second feed roller which may be disposed along the first supplying path.

The second length may be the distance from the first feed roller to a transfer roller which may be disposed on the second supplying path.

The selection guide unit may be a moveable guide unit having a common branch and a pair of sub-branches and as the guide unit moves in a first direction, the common branch may block the second supplying path to feed the printing medium toward the first supplying path. As the selection guide moves in a second direction, the common branch may block the first supplying path to feed the printing medium toward the second supplying path.

As a leading edge of the printing medium contacts the second feed roller disposed on the first supplying path, the first feed roller does not feed.

The foregoing and/or other utilities of the present general inventive concept may also be achieved by providing an image forming apparatus including a selection guide unit to selectively guide a printing medium in a first direction toward a first image forming apparatus formed on a first supplying path and toward a second image forming apparatus formed on a second supplying path, a first feed roller to feed the printing medium along the first supplying path and the second supplying path.

BRIEF DESCRIPTION OF THE DRAWINGS

The above and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
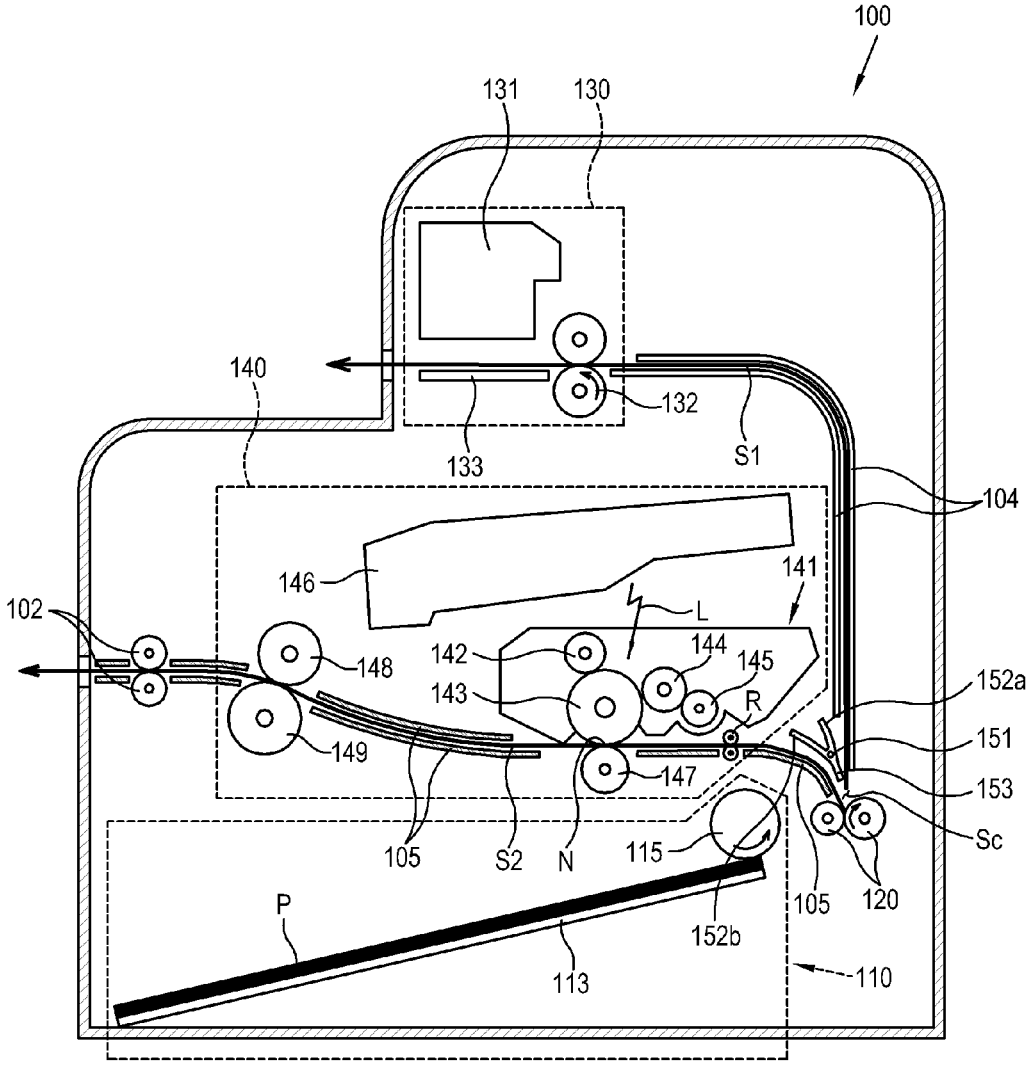
FIG. 1 is a schematic sectional view illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

As illustrated in FIG. 1, an image forming apparatus 100 according to the present general inventive concept includes a printing medium supplier 110, a first feed roller 120, a first image forming unit 130, a second image forming unit 140 and a selection guide 150.

The printing medium supplier 110 includes a plate 113 which stores a printing medium P to be supplied to the first and second image forming units 130 and 140, and a pickup roller 115 which picks up the printing medium P from the plate 113.

The printing medium P is picked up by the pickup roller 115 and transferred to the first feed roller 120.

The first feed roller 120 aligns the picked printing medium P and transfers the aligned printing medium P to the selection guide 150 by a controller 180 which will be described in further detail below.

Figure 2:
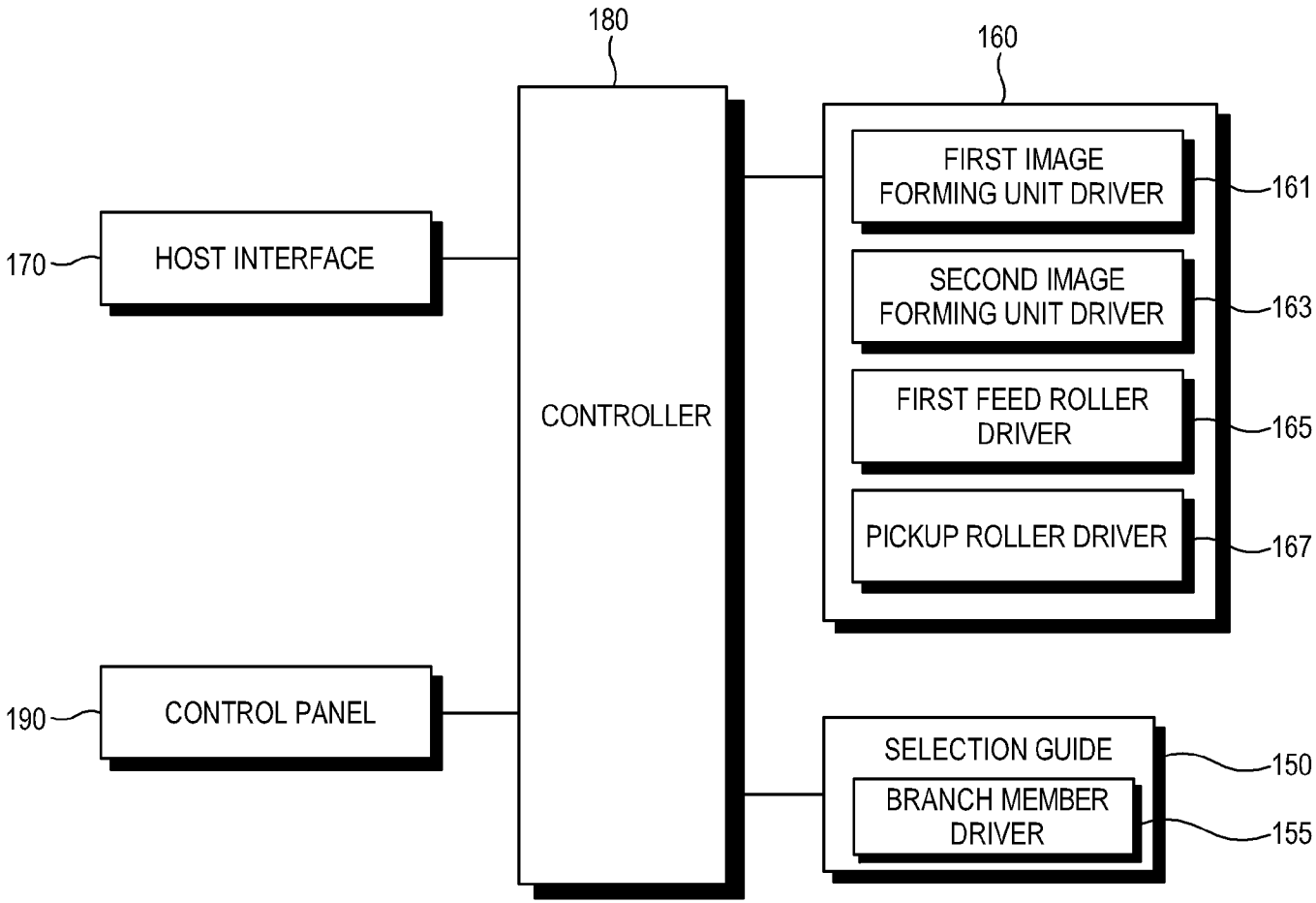
FIG. 2 is a block diagram illustrating the image forming apparatus in FIG. 1.

As illustrated in FIGS. 1-2, the selection guide 150 includes a rotation shaft 151, a branch member 152 which rotates with respect to the rotation shaft 151 and a branch member driver 155 to drive the branch member 152.

The branch member 152 rotates to supply the printing medium P that is picked up by the pickup roller 115 to one of a first supplying path S1 of the first image forming unit 130 or a second supplying path S2 of the second image forming unit 140. As illustrated in FIG. 1, the branch member 152 may have a Y-shape, including a common branch 153 and a pair of sub-branches 152*a* and 152*b*. The common branch 153 extends in a lower direction and the pair of sub-branches 152*a* and 152*b* extend in opposing directions with respect to each other and in a direction opposite to the common branch 153. However, the present general inventive concept is not limited thereto. For instance, the branch member 152 may vary in shape and size as long as it performs the designated function of the selection guide 150.

Figure 3:
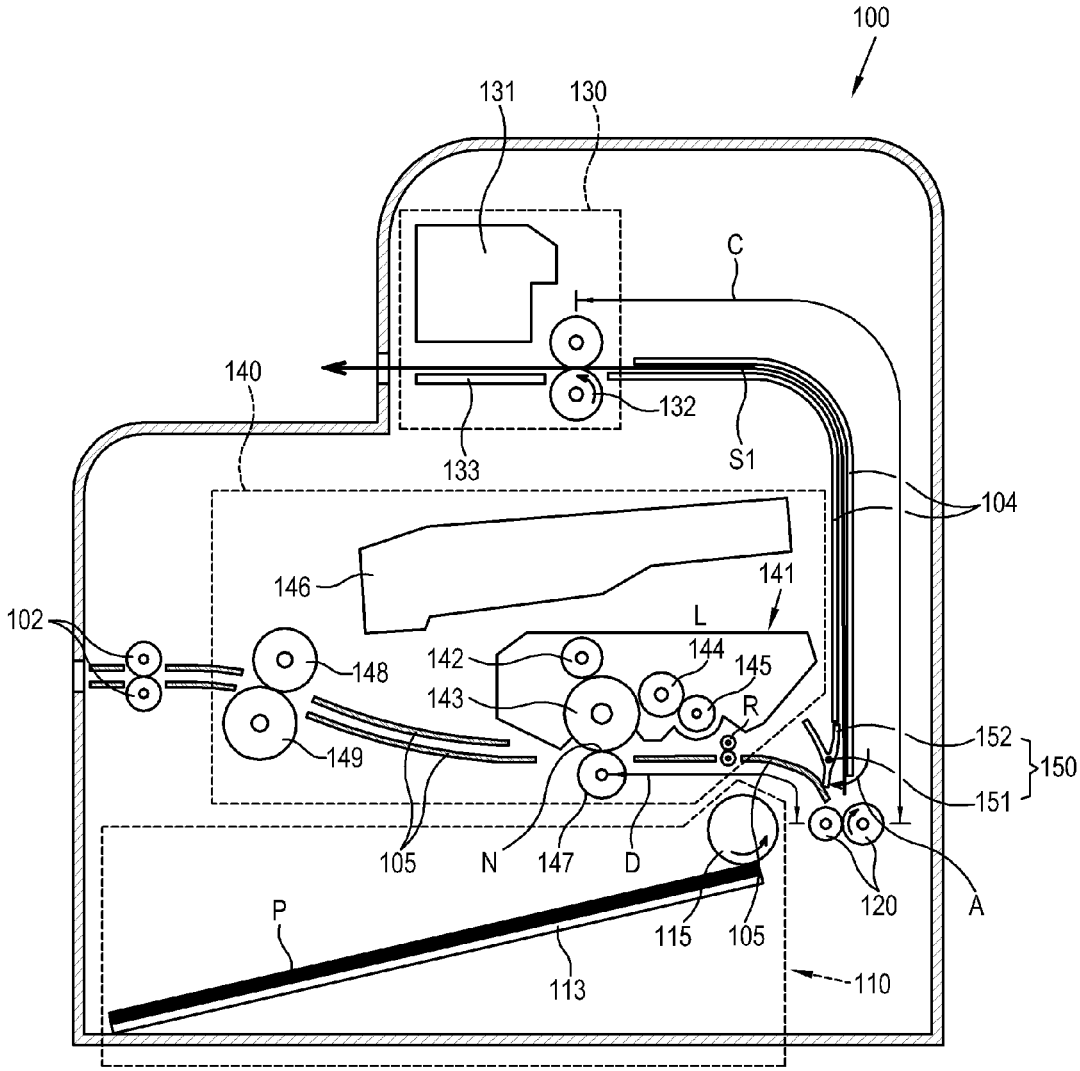
FIG. 3 is a schematic sectional view illustrating a printing process of a first image forming unit of the image forming apparatus in FIG. 1.

As illustrated in FIGS. 2-3, the branch member driver 155 includes an electric motor which rotates the branch member 152 clockwise and counterclockwise, depending upon the selected image forming apparatus. In particular, as the electric motor rotates the branch member 152 clockwise, the sub-branch 152*a* is aligned with a portion of guide 104 and the common branch 153 moves in an opposite direction to contact the second supplying path S2 to connect a common path Sc to the first supplying path S1 and block the second supplying path S2 from the common path Sc. As a result, the printing medium P is supplied from the common printing path Sc to the first supplying path S1 to connect the common path Sc to the second supplying path S2 and to block a connection between the common path Sc and to first supplying path S1. Alternatively, when the electric motor rotates the branch member 152 counter-clockwise, the sub-branch 152*b* is aligned with a potion of guide 105 and the common branch 153 moves in an opposite direction to contact the first supplying path S1. As a result, the printing medium P is supplied from the common printing path Sc to the second supplying path S2. A solenoid may be provided when necessary to rotate the branch member 152 clockwise and counterclockwise. Additionally, the branch member 152 of the present general inventive concept is not limited thereto and may be driven by any other known methods.

The guides 104 include a pair of first guides which are spaced apart and form and form the first supplying path S1 therein. Similarly, the guides 105 include a pair of second guides which are spaced apart and form the supplying path S2 therein.

In particular, first supplying path S1 includes the pair of guides 104 which connect from the branch member 152 to the first image forming unit 130. The second supplying path S2 includes the pair of guides 105 which connect from the branch member 152 to the second image forming unit 140.

The first image forming unit 130 may be any one of a variety of an inkjet types. For example, the first image forming unit 130 may be a shuttle type which moves a printing head back and forth, transverse to a supply direction of the printing medium P. The printing head (not illustrated) of the image forming unit includes a plurality of nozzles (not illustrated) to discharge ink droplets and may be disposed in a carrier 131 which also moves back and forth, transverse to the supply direction of the printing medium P.

The first image forming unit 130 also includes a second feed roller 132 which moves the printing medium P toward the carrier 131 resting on a platen 133 which is disposed under the carrier 131 and supports the printing medium P as the printing medium P is printed with the discharged ink droplets. The second feed roller 132 may includes a pair of rollers that are rotated by a driving force which rotates one of the rollers to activate both rollers. The driving force can be produced by any suitable driving member known in the art.

The first image forming unit 130 may also include a page-width printing head type having a printing head with a length equivalent to a width of the printing medium P to print a line of image data at one time, in contrast to the shuttle type in which the printing head moves by the carrier 131, back and forth across the width of the printing medium P.

As illustrated in FIG. 1, the second image forming unit 140 may be an electrophotographic type having a developing cartridge 141, an exposing unit 146, a registration roller R, a transfer roller 147, and fusing units 148 and 149.

The developing cartridge 141 stores a toner member to develop an image that is formed on an image receptor 143. The developing cartridge 141 may accommodate the image receptor 143, a charging roller 142 to charge a surface of the image receptor 143 with a predetermined electric potential, a developing roller 144 to develop the image receptor 143 with the toner, and a supplying roller 145 to supply the stored toner to the developing roller 144.

The registration roller R aligns the printing medium P to be supplied to the image receptor 143. If the first feed roller 120 is driven by a driving force and moves the printing medium P toward the registration roller R, the printing medium P touches the registration roller R in an idle state, and is then aligned.

The image receptor 143 may be a photosensitive drum. The image receptor functions such that an electrostatic latent image is formed on the surface of the image receptor 143 by the exposing unit 146 which exposes a light L according to a transmitted signal that corresponds to the image data to be printed. The exposing unit 146 exposes the light L when the aligned printing medium P starts moving toward the image receptor 143 by the registration roller R. Methods of driving the exposing unit 146 and the registration roller R are well known in the art, and thus the detailed description thereof will be omitted.

The electrostatic latent image is developed, with the toner, by the developing roller 144 and forms a toner image on the surface of the image receptor 143.

The transfer roller 147 transfers the toner image to the printing medium P when it is disposed between the transfer roller 147 and the image receptor 143. In particular, the transfer roller 147 is engaged with the image receptor 143 to form a transfer nip N, and the toner image is transferred from the transfer nip N to the printing medium P.

The toner image that is transferred to the printing medium P is fused to the printing medium P by heat and pressure from the fusing units 148 and 149. The fusing units 148 and 149 include a heat roller 148 to generate heat, and a press roller 149 to press the printing medium P to the heat roller 148.

The printing medium P passing through the fusing units 148 and 149 is discharged to the outside of the image forming apparatus by a discharging roller 102.

As illustrated in FIG. 2, the image forming apparatus 100 according to the embodiment of, the present general inventive concept, as illustrated in FIG. 1 includes a host interface 170 which transmits and receives image data from/to a host device (not illustrated), a control panel 190, and a driver 160.

The host interface 170 may include a parallel interface, a USB interface, or a network interface such as LAN to connect with the host device.

The control panel 190 includes an input key (not illustrated) to select either the first image forming unit 130 or the second image forming unit 140, and a display unit (illustrated) to display items selected by the input key. When a user selects either the first or second image forming units 130 and 140, the specific image forming type is automatically determined in the host device by image forming unit drivers installed in the host device. The image forming type is transmitted to the image forming apparatus 100 through the host interface 170 without the user having to directly input the image forming type.

The driver 160 may include a first image forming unit driver 161, a second image forming unit driver 163, a first feed roller driver 165 and a pickup roller driver 167. The plurality of drivers 161, 163, 165 and 167 may be provided using a known power transmission member such as, a driving motor, one-way gear, swing gear and electronic clutch. The number of driving motors must be greater than 1 may be determined according to need. The driver 160 may also be one known to those skilled in the art, and thus a detailed description of the driver 160 will be omitted herein.

The first image forming unit driver 161 drives the first image forming unit 130 to form an image according to a specified inkjet type, as discussed above. The first image forming unit driver 161 also drives the carrier 131 and the second feed roller 132 of the first image forming unit 130.

The second image forming unit driver 163 drives the second image forming unit 140 to form an image according to the specifications of the electrophotograhic type. The second image forming unit driver 163 also drives various rotation bodies 142, 143, 144, 145, 147, 148, 149 and R of the second image forming unit 140.

The first feed roller driver 165 and the pickup roller driver 167 drive the first feed roller 120 and the pickup roller 115, respectively.

The operation of the image forming apparatus 100 including the foregoing elements will now be described with reference to FIGS. 3 and 4 below.

The controller 180 determines whether the host interface 170 has supplied image data that corresponds to a printing request. Also, the controller 180 determines which one of the first and second image forming units 130 and 140 is selected to print the supplied image data and accordingly determines the image forming type. In particular, the image forming type may be determined by analyzing either the supplied image data or the result input through the control panel 190.

If it is determined that the first image forming unit 130 (i.e., the inkjet type) is selected to print the image data, the printing operation is performed by following printing processes associated with the selected inkjet type.

As illustrated in FIG. 3, after the first image forming unit 130 is selected, the controller 180 controls the selection guide 150 to guide the printing medium P in the printing medium supplier 110 toward the first supplying path S1. That is, the controller 180 controls the branch member driver 155 to rotate the branch member 150 clockwise (A), and opens the first supplying path S1 but closes the second supplying path S2.

The controller 180 controls the driver 160 to pick up the printing medium P from the plate 113 by the pickup roller 115 and move it toward the first feed roller 120. Then, the first feed roller 120 moves the picked printing medium P toward the selection guide 150. When the printing medium reaches the first feed roller 120 and the first feed roller 120 is driven, the printing medium P is transferred solely by the first feed roller 120 by setting the pickup roller 115 in idle state. Such an operation moves the printing medium P precisely towards the desired supplying path.

The controller 180 controls the selection guide 150 so that the branch member 152 closes the second supplying path S2 and opens the first supplying path S1. Thus, the printing medium P is supplied to the first image forming unit 130 along the first supplying path S1.

A grip distance C, which extends from the first feed roller 120 to the second feed roller 132 on the first supplying path S1, is shorter than a length of a predetermined printing medium P so that as a front end of the printing medium P transfers along the first supplying path S1 it is almost instantly gripped by the second feed roller 132.

Here, the predetermined printing medium P refers to the smallest standard printing medium which may be used in the image forming apparatus 100. For example, if A4 and B5 are the standard sizes of the printing media that can be used in the image forming apparatus 100, the smaller B5 size (182 mm×257 mm) is the predetermined printing medium P. Assuming that the printing medium P is always supplied in a portrait direction, the first and second feed rollers 120 and 132 are disposed accordingly to set the grip distance C to be shorter than 257 mm (i.e., the length of the B5 printing medium). Thus, an additional roller is not required between the first feed roller 120 and the second feed roller 132 to move the printing medium P.

The controller 180 controls the driver 160 to set the second feed roller 132 in an idle state for a predetermined time so that the printing medium P transferred by the first feed roller 120 is aligned. Then, the front end of the printing medium P that transfers along the first supplying path S1 is aligned when the front end of the printing medium P touches the second feed roller 132 in the idle state.

After the printing medium P is aligned, the second feed roller 132 is driven to move the printing medium P to the carrier 131. The controller 180 controls the driver 160 to set the first feed roller 120 in the idle state while the second feed roller 132 grips and moves the printing medium P. If both ends of the printing medium P are gripped by the first and second feed rollers 120 and 132, the printing medium P may not be transferred along the supplying path S1 precisely due to minute speed differences between the rollers 120 and 132.

The carrier 131 moves transverse to the supplying direction (i.e., the vertical direction) of the printing medium and forms an ink image on the printing medium P that is transferred by the second feed roller 132. Thus, the image is formed on the printing medium P by the designated inkjet type.

Meanwhile, if a user requests a printing operation by the second image forming unit 140, i.e., by the electrophotographic type, the printing operation is performed by following printing processes according to the second image forming unit or electrophotographic type.

Figure 4:
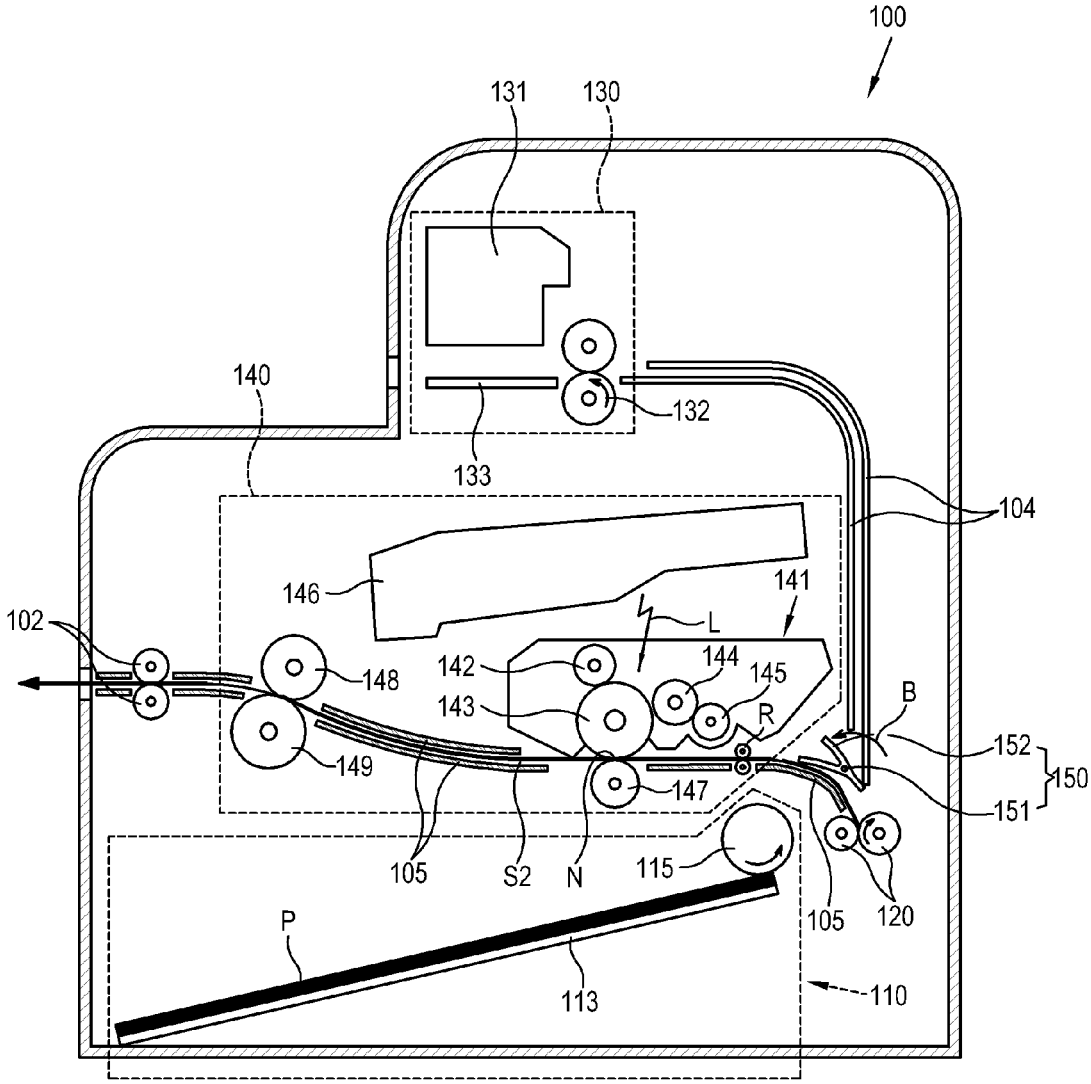
FIG. 4 is a schematic sectional view illustrating a printing process of a second image forming unit of the image forming apparatus of FIG. 1.

As illustrated in FIG. 4, the controller 180 controls the selection guide 150 to supply the printing medium P to the second image forming unit 140 according to a user's selection. That is, the controller 180 controls the branch member driver 155 to rotate the branch member 152 counterclockwise (B) and close the first supplying path S1 but open the second supplying path S2.

A grip distance D, which extends from the first feed roller 120 to the image receptor 143 and transfer roller 147 on the second supplying path S2 is shorter than a length of the predetermined printing medium P so that as a front end of the printing medium P transfers along the first supplying path S2 it is almost instantly gripped by the image receptor 143 and transfer roller 147.

The printing medium P is picked up by the pickup roller 115 and then transferred toward the selection guide 150 by the first feed roller 120. The printing medium P is guided to the second supplying path S2 by the selection guide 150.

The printing medium P that is transferred along the second supplying path S2 is aligned by the registration roller R which is in an idle state. After the printing medium P is aligned, the controller 180 drives the exposing unit 146 to expose a light L to the image receptor 143, and simultaneously drives the registration roller R to transfer the printing medium P between the image receptor 143 and the transfer roller 147.

The distance from the first feed roller 120 to the location where the image receptor 143 and the transfer roller 147 engaged with each other (i.e., to the transfer nip N), is shorter than the length of the predetermined printing medium P. The predetermined printing medium P is described above, and thus the description will not be repeated herein.

If the printing medium P is gripped between the image receptor 143 and the transfer roller 147, the controller 180 controls the driver 160 to set the first feed roller 120 and the registration roller R in the idle state. The printing medium P is then transferred by the image receptor 143 and the transfer roller 147 since it is gripped by both the image receptor 143 and the transfer roller 147. In this case, the minute vibrations applied to the printing medium P from the differences in rotation speed of the transfer roller 147 and image receptor 143 are minimal and will not negatively affect the precision by which the printing medium P is transferred along the supplying path S2. Thus the number of the rotation bodies which grip and drive the printing medium P is reduced, thereby moving the printing medium P more precisely and improving printing quality.

As the printing medium P passes between the image receptor 143 and the transfer roller 147, the toner image formed on the image receptor 143 is transferred to the printing medium P. The transferred toner image is fused to the printing medium P by the fusing units 148 and 149, thereby completing the printing operation according to the electrophotographic type. The printed printing medium P is then discharged to the outside by the discharging roller 102.

As described above, the first image forming unit 130 and the second image forming unit 140 form an image according to the inkjet type and the electrophotographic type, respectively, and vice versa. The first and second image forming units 130 and 140 may alternatively form an image according to other known image forming types such as a thermoelectronic type.

According to another embodiment of the present general inventive concept, the first feed roller 120 may align a printing medium P instead of a registration roller R and a second feed roller 132. In this case, the registration roller R may be removed.

More specifically, when a pickup roller 115 is driven to pick up the printing medium P stored in the plate 113, the driver 160 is controlled to set the first feed roller 120 in an idle state. As a front end of the printing medium P touches the first feed roller 120 it is then aligned. The aligned printing medium P is transferred along the first supplying path S1 or the second supplying path S2 depending upon the rotation of the selection guide 150 with respect to the rotation of the first feed roller 120. The first feed roller 120 aligns the printing medium P to be supplied to both the first image forming unit 130 and the second image forming unit 140, thereby reducing the number of components.

The timing of transferring the printing medium P along the second supplying path S2 by the first feed roller 120 to the second image forming unit 140 may be set taking into account the amount of time it takes to develop the image on the image receptor 143 of the second image forming unit 140. Alternatively, if the image is printed by the first image forming unit 130, the timing of transferring the printing medium P along the first supplying path S1 may be also set taking into account the amount of time it takes to form the inkjet type image on the printing medium P.

Thus, an image forming apparatus according to the present general inventive concept has many benefits, among them including:

First, the image forming apparatus employs a common feed roller (i.e., the first feed roller) in front of a selection guide to transfer a printing medium to respective image forming units, thereby simplifying a printing medium moving configuration. Also, the number of components and production costs are reduced.

The controller 180 controls the feed roller 120 disposed in the common path Sc to feed the printing medium along the first path S1 for a first period of time and along the second path S2 for a second period of time. The first path S1 extends along the grip distance C and thus the first period of time corresponds to the length of time that the printing medium P travels along the first path S1 and grip distance C. Alternatively, the second path S2 extends along the grip distance D and thus the second period of time corresponds to the length of time that the printing medium P travels along the second path S2 and grip distance D. Thus, the first period of time is longer than the second period of time and the length C is longer than a length D.

When a leading edge of the printing medium P is fed by either the second feed roller 132 or the transfer roller 147, the first feed roller 120 does not receive a rotating power from a motor but idles or stops feeding.

Second, a distance from a first feed roller to a second feed roller is shorter than a length of a printing medium, thereby eliminating a need for an additional roller to transfer the printing medium. Thus, a printing medium transferring configuration is simplified and the number of components is reduced.

Third, a first feed roller is set into an idle state since a printing medium is gripped by a second feed roller or a transfer nip, thereby transferring the printing medium more precisely. Also, the quality of an image formed on a printing medium is improved.

Although a few embodiments of the present general inventive concept have been illustrated and described, it will be appreciated by those skilled in the art that changes may be made in the foregoing embodiments without departing from the principles and spirit of the general inventive concept, the scope of which is defined in the appended claims and their equivalents.

What is claimed is:

1. An image forming apparatus, comprising:

a printing medium supplier to supply a printing medium having a predetermined length;

a selection guide to selectively guide the printing medium from the printing medium supplier to one of a first supplying path of a first image forming unit and a second supplying path of a second image forming unit;

a first feed roller disposed between the selection guide and the printing medium supplier to move the printing medium from the printing medium supplier to the selection guide; and a second feed roller disposed between the selection guide and the first image forming unit to transfer the printing medium guided along the first supplying path to the first image forming unit, wherein a distance from the first feed roller to the second feed roller is shorter than the predetermined length of the printing medium, and the selection guide unit is a moveable guide unit having a common branch and a pair of sub-branches, and as the guide unit moves in a first direction, the common branch blocks the second supplying path to feed the printing medium toward the first supplying path, and as the selection guide moves in a second direction, the common branch blocks the first supplying path to feed the printing medium toward the second supplying path.

2. The image forming apparatus according to claim 1, wherein the first image forming unit and the second image forming unit are different image forming types.

3. The image forming apparatus according to claim 1, further comprising:

a driver to drive the first feed roller and the second feed roller.

4. The image forming apparatus according to claim 3, further comprising:

a controller to control the driver to drive the first feed roller while the second feed roller is in an idle state, to align the printing medium.

5. The image forming apparatus according to claim 3, further comprising:

a controller to control the driver to set the first feed roller in an idle state if the second feed roller grips the printing medium.

6. The image forming apparatus according to claim 1, wherein the first image forming unit comprises a printing head which has a nozzle to discharge an ink.

7. The image forming apparatus according to claim 1, wherein the second image forming unit comprises an image receptor to form a toner image thereon, and a transfer roller to grip the printing medium as it is guided along the second supplying path having the image receptor and to transfer the toner image to the printing medium.

8. The image forming apparatus according to claim 7, wherein a distance from the first feed roller to the image receptor or the transfer roller that grips the printing medium is shorter than a length of the printing medium.

9. The image forming apparatus according to claim 8, further comprising:

a driver to drive the image receptor, the transfer roller and the first feed roller; and a controller to control the driver to set the first feed roller in an idle state if the printing medium is gripped by the image receptor and the transfer roller.

10. The image forming apparatus according to claim 1, wherein the printing medium supplier comprises a plate to store the printing medium therein, and a pickup roller to pick up the printing medium and transfer the printing medium to the first feed roller.

11. The image forming apparatus according to claim 10, further comprising:

a driver to drive the first feed roller and the pickup roller.

12. The image forming apparatus according to claim 11, further comprising:

a controller to control the driver to set the pickup roller in an idle state after the driver drives the first feed roller.

13. The image forming apparatus according to claim 11, further comprising:

a controller to control the driver to drive the pickup roller while the first feed roller is in an idle state, to align the printing medium.

14. The image forming apparatus according to claim 1, further comprising:

a controller to control the selection guide to select one of the first and second supplying paths corresponding to a user's selection.

15. The image forming apparatus of claim 1, wherein the image forming apparatus is usable with a plurality of printing media each having different predetermined lengths, and the printing medium has a shortest predetermined length of the plurality of printing media.

16. An image forming apparatus, comprising:

a printing medium supplier to supply a printing medium; and a selection guide to selectively guide the printing medium from the printing medium supplier to one of a first supplying path of a first image forming unit and a second supplying path of a second image forming unit, wherein the selection guide is a moveable guide unit having a common branch and a pair of sub-branches, and as the selection guide moves in a first direction, the common branch blocks the second supplying path to feed the printing medium toward the first supplying path, and as the selection guide moves in a second direction, the common branch blocks the first supplying path to feed the printing medium toward the second supplying path.

* * * * *